United States Patent [19]

Fentiman

[11] Patent Number: 4,844,648

[45] Date of Patent: Jul. 4, 1989

[54] CONNECTOR SYSTEM

[76] Inventor: Arthur E. Fentiman, R.R. #2, Stittsville, Ontario, Canada, K0A 3G0

[21] Appl. No.: 206,878

[22] Filed: Jun. 10, 1988

[30] Foreign Application Priority Data

Jan. 28, 1988 [CA] Canada ..... 557597

[51] Int. Cl.[4] ..... F16B 1/00

[52] U.S. Cl. ..... 403/171; 403/176

[58] Field of Search ..... 403/171, 176, 175, 174, 403/178, 170

[56] References Cited

U.S. PATENT DOCUMENTS

| | | | |
|---|---|---|---|
| 4,044,497 | 8/1977 | Bettens | 403/170 X |
| 4,709,241 | 11/1987 | Cusson | 403/174 X |

FOREIGN PATENT DOCUMENTS

| | | | |
|---|---|---|---|
| 321611 | 1/1931 | Canada . | |
| 743695 | 10/1966 | Canada | 20/118 |
| 1017525 | 9/1977 | Canada | 20/122 |
| 1514258 | 1/1968 | France | 403/175 |

*Primary Examiner*—Andrew V. Kundrat

*Attorney, Agent, or Firm*—Sixbey, Friedman, Leedom & Ferguson

[57] ABSTRACT

A novel system of connectors and elongated tubes joined together thereby to form a variety of rigid three-dimensional rectangular structures. The connectors of the present invention have a central body with a plurality of outwardly extending arms, the arms to seatably engage open ends of the tubes. The connectors are made from extruded components and hence require a minimum of machining. The elongated tubes have notched ends permitting tubes, internally situated within a three-dimensional structure formed therefrom, to be removed or reconfigured.

16 Claims, 2 Drawing Sheets

CONNECTOR SYSTEM

This invention relates to a novel system of connectors and elongated tubes joined together thereby to form a variety of rigid three-dimensional rectangular structures. More particularly the present invention relates to such systems in which the connectors have a central body with a plurality of outwardly arms or pins, such arms to seatably engage the ends of open-ended tubes, which tubes extend between such connectors.

BACKGROUND OF THE INVENTION

In the past, such systems, when erected to form a three-dimensional structure, have had the disadvantage of requiring the tubes and connectors to be disconnected from the outer periphery of the structure to the inside, for example when it has been desired to modify the configuration of an inner portion of the structure. This has been because the ends of the tubes have had to be seated on the corresponding arms by longitudinal movement of the tubes to insert the arms into the open ends of the tubes. Thus, when it has been necessary to reconfigure an internal area of the structure, because of the rigid, overall construction of the structure, it has been necessary to start at the outside of the structure and remove tubes and connectors in sequence until they have been "eaten away" to the area where reconfiguration is desired. The time and effort required to do this may be excessive.

Another difficulty with such systems has been the difficulty in constructing a suitable connector since such connectors have an unusual shape, with arms extending outwardly in many different directions. Thus, manufacturing such connectors has conventionally required a relatively complicated mold or relatively complicated machining operations, in this latter case with much wastage of material.

The systems of the present invention provide demountable structures which have many applications, for example to form rigid three-dimensional display sections for museums, trade shows and the like.

Canadian patent No. 1,017,525 of Florence issued Sept. 20, 1977 describes a conventional system of connectors and tubes of the type in question. Other patents of general background interest describing connector assemblies for tubular structures are Canadian patents Nos. 743,695 of Gatterre issued Oct. 4, 1966 and 321,611 of Ragsdale issued April 1932.

It is an object of the present invention to provide a system of connectors and elongated tubes for forming a rigid three-dimensional rectangular structure, which system permits reconfiguration of internal portions of the structure without the need of having to dismantle outer portions of the structure.

It is a further object of the present invention to provide connectors for such a system which may be economically and simply cut from extrusions.

SUMMARY OF THE INVENTION

In accordance with the present invention there is provided a connector having a body with arms outwardly extending therefrom to seatably receive thereon the ends of elongated, open-ended tubes. The tubes when their ends are in position on other similar connectors form a rigid, three-dimensional rectangular structure. The connector is formed from a plurality of extrusions. A first extrusion is shaped with arms outwardly extending in sideways, normal fashion from a body with a hole in the middle thereof. A second extrusion is a bar of similar external configuration to that of the hole and of similar cross-sectional shape and size to that of the arms of the first extrusion. The second extrusion is received in the hole in orientation perpendicular to that of the arms of the first extrusion and is centrally secured in that hole so that the ends of bar constitute further arms of the connector. A securing means is provided to securely hold the bar in position in the hole of the first extrusion.

In a preferred embodiment, the sides of the body are of rectangular configuration and the arms and bar are of similar rectangular configuration. The connector is further provided with similarly shaped third extrusions of rectangular shape and outer size to conform to that of the body and a central hole of size and shape to conform to that of the hole of the first extrusion. The third extrusions are securably seated on the second extrusion on opposite sides of the first extrusion.

Connectors provided in conjunction with the present invention may be formed from extrusions of appropriate material (aluminum or other appropriate metal, for example) by simply cutting from long extruded pieces of the appropriate external shape, pieces of appropriate thickness.

The present invention further relates to the system provided when such connectors are used in conjunction with open-ended tubes to be seatably received on the arms. The tubes have notches at each end to permit lateral passage therethrough of the corresponding arms of the connectors so that the tubes can be seated on the arms by lateral movement of the tubes with respect to the arms. Means are provided for releasably securing the ends of the tubes to corresponding arms of the connectors.

The use of tubes of the construction in accordance with the invention, extending between connectors of this type, permits any tube, anywhere in a three-dimensional structure formed from such connectors and tubes, to be removed or replaced without the need of having to dismantle the structure from its outer edges until that particular tube is exposed. Because of the notched construction of the tubes, little or no structural strength is lost in the tubes when secured in position. (The tubes will normally be positioned on the connector arms with the notched side positioned below.)

BRIEF DESCRIPTION OF THE DRAWINGS

These and other objects and advantages of the invention will become apparent upon reading the following detailed description and upon referring to the drawings in which.

Figure 1:
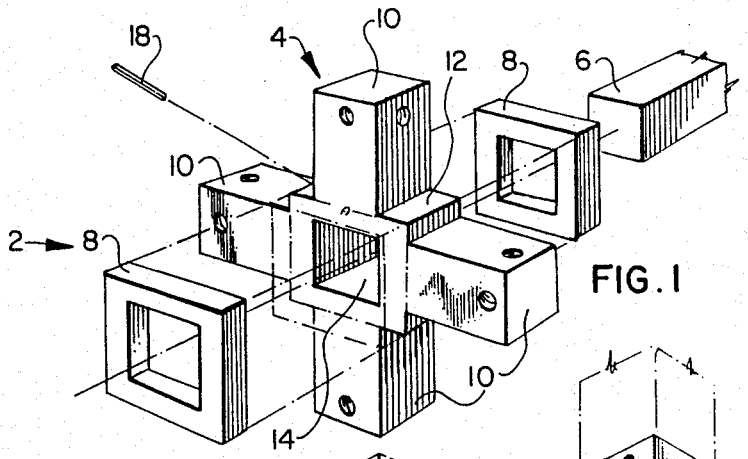
FIG. 1 is an exploded view of a connector in accordance with the present invention.

While the invention will be described in conjunction with an example embodiment, it will be understood that it is not intended to limit the invention to such embodiment. On the contrary, it is intended to cover all alternatives, modifications and equivalents as may be included within the spirit and scope of the invention as defined by the appended claims.

DETAILED DESCRIPTION OF THE DRAWINGS

In the drawings, similar features have been given similar reference numerals.

Turning to FIG. 1 there is illustrated an exploded view of a connector 2 in accordance with the present invention. As can be seen, the connector is made of a first extrusion 4, second extrusion 6 and a pair of third extrusions 8. First extrusion 4 is shaped with arms 10, of square cross-sectional shape, extending outwardly from body portion 12 in normal fashion to each side. The sides of body portion 12 form a square. A hole 14, of square appearance, is centrally disposed in body 12.

The second extrusion bar 6 is elongated as illustrated, and has a length similar to the distance between opposite ends of opposite pairs of arms 10. Bar 6 is centrally secured within hole 14 in extrusion 4 by means of a spring clip 18 seated in a hole through body 12 and extending into bar 6.

Secured to bar 6, on either side of and adjacent to first extrusion 4 are similarly shaped third extrusions 8 as illustrated. The shape and outer size of the sides of extrusions 8 conform to that of the sides of body 12, as illustrated, so that, in this embodiment of the invention, these extrusions 8 in position on bar 6 as illustrated (FIG. 2), form, with central portion of first extrusion 4, a central body portion 22 for the entire connector of cubic shape, with arms 10 (including the ends of bar 6) extending outwardly, an equal distance, as if from the center of each of the faces of the square formed by body portion 22. Third extrusions 8 are secured in position on bar 6 by means of any appropriate securing mechanism such as, for example, by tapping (23).

While illustrated as being respectively of square cross-section and square external shape, arms 10 and body 22 may be of other cross-sections and external shapes, e.g. rectangular.

Figure 2:
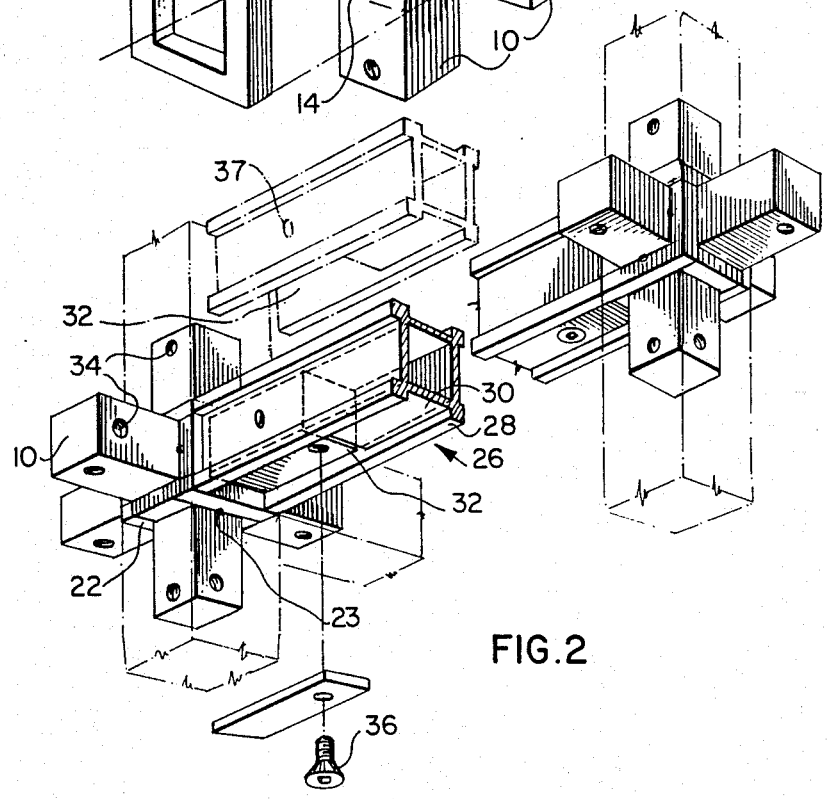
FIG. 2 is a perspective view of an assembled connector in accordance with FIG. 1 illustrating the manner in which tubes in accordance with the present invention may be connected thereto.

Cooperating with arms 10 are a plurality of hollow, open-ended tubes 26 (FIG. 2). As can be seen in FIG. 2, tubes 26 are generally square cross-section, with a central passageway of square shape. The sides 28 of each tube 26 are provided with a longitudinal groove 30 extending the length of the tube. A notch 32 is provided at each end of each tube 26, on one side, the notch being of sufficient length and width to permit passage therethrough of an arm 10. In this manner, when a tube is to be seated, at each end, on the arms of connectors 2, it is not necessary to move the tube, relative to the arms 10 in a longitudinal fashion. Instead, when the opposite connectors are properly positioned, the tube 26 may be simply moved (in FIG. 2) downwardly (laterally) with respect to the arms, so that these arms pass through notches 32 into seated engagement with respect to the tubes. It is preferred that similarly positioned, tapped and threaded holes 34 be provided towards the ends of each of the sides of arms 10, so that tubes 26 may be secured to corresponding connectors 2 by means of appropriate threaded bolts 36 passing through aligned holes 37 in tubes 26 as illustrated.

The system of connectors 2 and tubes 26 in accordance with the present invention is very versatile. When it is desired to secure, for example, panels within the planes formed by a square or rectangle of tubes 26 and connectors 2, a clip 40 (FIGS. 4, 5) having flanges 42 normal to a central body portion 43 may be provided. A notch 46, to receive a corner portion of square body 22 is preferably provided at one corner thereof, and appropriate bolt receiving holes 48 provided in each of the flanges and appropriately positioned, so that when clip 40 is seated in a corner of the system as illustrated in FIG. 4, it is secured in position by means of the same threaded bolt 36 which holds the tubes 26 in place on arms 10.

It is preferred that the cross-sectional dimensions of body 22 be slightly greater than the outer cross-sectional dimensions of tubes 26, to facilitate the placement and removal of tubes 26 on connectors 2.

To corresponding clips 40 secured in the other corners of the square or rectangle formed by tubes 26, a panel 49 may be thereby securely positioned in the plane formed by these tubes.

Figure 4:
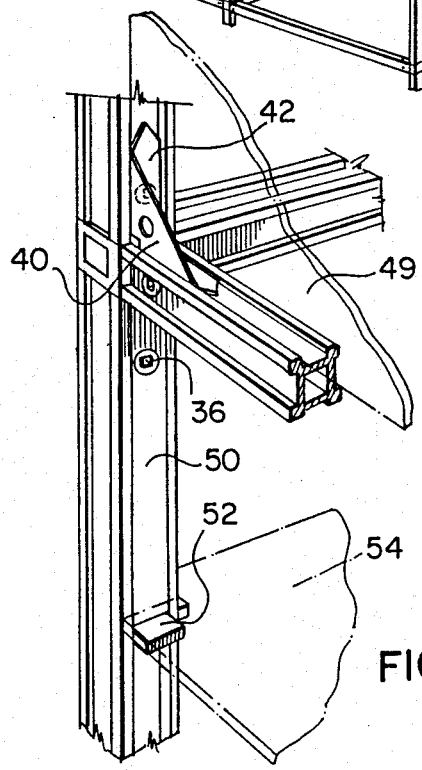
FIG. 4 is a perspective view of a portion of the structure of FIG. 3 illustrating a structure in accordance with the present invention for holding panels on the tubes in horizontal position.
Figure 5:
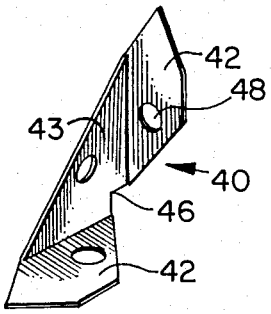
FIG. 5 is an enlarged perspective view of a portion of the structure of FIG. 3 illustrating a structure in accordance with the present invention for holding panels in vertical or other positions in the structure.

As can be seen in FIG. 4, within groove 30 may be seated a strap 50, with outwardly extending projections 52 normal thereto, these straps being securable, for example, by means of threaded bolts 36 to tubes 26 and arms 2 as illustrated. When straps 50 are secured to adjacent, vertically oriented tubes, and projections 52 are similarly vertically positioned and properly oriented, they may support in horizontal fashion a panel 54 at an appropriate height intermediate vertically spaced connectors 2.

While not illustrated, the grooves 30 of tubes 26 may be used to hold in position and support many different constructions of desired elements, such as railings, holders for screens and the like.

Figure 3:
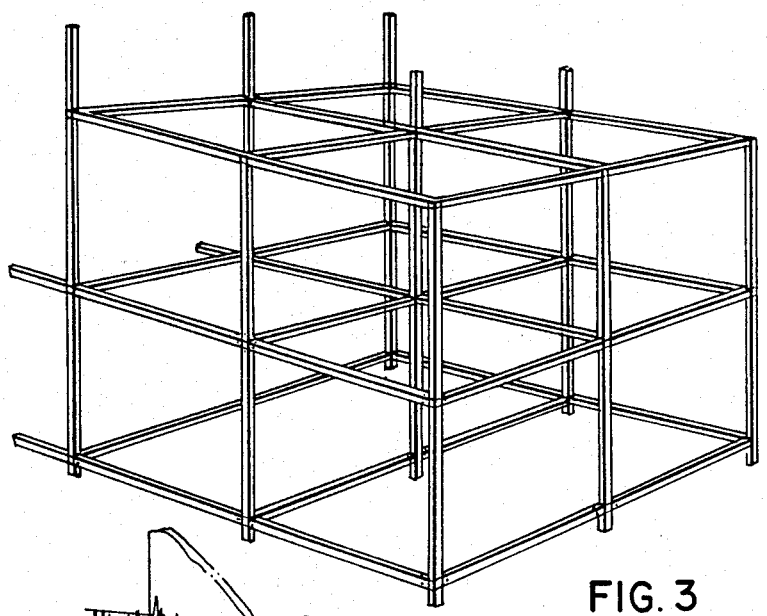
FIG. 3 is a perspective view of a three-dimensional rectangular structure made using connectors and tubes in accordance with the present invention.

As previously indicated, one of the main advantages in accordance with the present invention is that when it is desired to rearrange tubes and connectors at an interior location of a three-dimensional structure such as the one illustrated in FIG. 3, such rearrangement can take place by immediately removing and rearranging the desired tubes and connectors. It is not necessary, as was previously the case in such systems, to remove outer connectors and tubes progressively, in the direction towards the area where rearrangement was desired.

Thus it is apparent that there has been provided in accordance with the present invention a connector and system utilizing same that fully satisfy the objects, aims and advantages set forth above. While the invention has been described in conjunction with a specific embodiment, it is evident that many alternatives, modifications and variations will be apparent to those skilled in the art in light of the foregoing description. Accordingly, it is intended to embrace all such alternatives, modifications and variations as fall within the spirit and broad scope of the invention.

What I claim as my invention:

1. In a connector having a body with arms outwardly extending therefrom to seatably receive thereon the ends of elongated, open-ended tubes, the tubes when their ends are in position on other similar connectors to form a rigid, three-dimensional rectangular structure, the improvement characterized by the connector being formed from a plurality of extrusions, a first extrusion shaped with arms outwardly extending in sideways, normal fashion from a body with a hole in the middle thereof, the body having sides of rectangular configuration, a second extrusion being a bar of similar external configuration to that of the hole and of similar cross-sectional shape and size to that of the arms of the first extrusion, received in the hole in orientation perpendicular to that of the arms of the first extrusion and centrally secured in that hole so that the ends of the bar constitute further arms of the connector, the arms and bar being of similar rectangular configuration, a securing means to securely hold the bar in position in the hole of the first extrusion, and a pair of similarly shaped third extrusion of rectangular shape and outer size conforming to that of the body and the third extrusion each having a central hole of size and shape conforming to those of the hole of the first extrusion, the third extrusion securely seated on the second extrusion on opposite side of the first extrusion.

2. A connector according to claim 1 wherein the body and third extrusions are respectively of square shape and external cross-section.

3. A connector according to claim 2 wherein the arms and second extrusion are of similar square cross-sectional shape.

4. A connector according to claim 3 wherein the extrusions are shaped and fitted together to provide a connector wherein the body of the first extrusion and the adjacent third extrusions form a cube and wherein the arms and bar provide a pin of similar length and square cross-sectional shape extending outwardly from each surface of the cube.

5. A connector according to claim 4 wherein the securing means comprises a spring clip fitted into a hole extending through the body of the first extrusion into the bar.

6. A system for forming a rigid, three-dimensional rectangular structure comprising a plurality of connectors in accordance with claim 4 in combination with open-ended tubes to be seatably received on the arms, the tubes having notches at each end to permit lateral passage therethrough of the corresponding arms of the connectors so that the tubes can be seated on the arms by lateral movement of the tubes with respect to the arms, securing means being provided for releasably securing the ends of the tubes to corresponding arms of the connectors.

7. A system for forming a rigid, three-dimensional rectangular structure comprising a plurality of connectors, each having a body with arms outwardly extending therefrom to seatably receive thereon the ends of elongated open-ended tubes, the tubes when their ends are in position on other similar connectors to form a rigid, three-dimensional rectangular structure, the connectors each being formed from a plurality of extrusion, a first extrusion shaped with arms outwardly extending in sideways, normal fashion from a body with a hole in the middle thereof, a second extrusion being a bar of similar external configuration to that of the hole and of similar cross-sectional shape and size to that of the arms of the first extrusion, received in the hole in orientation perpendicular to that of the arms of the first extrusion and centrally secured in that hole so that the ends of the bar constitute further arms of the connector, and a securing means to securely hold the bar in position in the hole of the first extrusion, the connectors being in combination with open-ended tubes to be seatably received on the arms, the tubes having notches at each end to permit lateral passage therethrough of the corresponding arms of the connectors so that the tubes can be seated on the arms by lateral movement of the tubes with respect to the arms, securing means being provided for releasably securing the ends of the tubes to corresponding arms of the connectors.

8. A system according to claim 8-wherein the notches are on the same side at each end of the tubes.

9. A system according to claim 7 wherein the notches are on the same side at each end of the tubes.

10. A system according to claim 9 wherein the tubes are of square cross-section With an inner, hollow passage of cross-sectional diameter so that the tubes will flushly fit on the arms.

11. A system according to claim 7 wherein the securing means comprise screws threadably securable through holes in the sides of the tubes into threaded holes in the arms.

12. A system according to claim 7 further comprising panel-receiving clip means having means releasably securable to the connectors between adjacent pairs of tubes in corresponding arms, the clip means providing a planar surface parallel to the plane of the adjacent arms, and means being associated with the clip means whereby a panel structure may be secured to said clip means.

13. A system according to claim 12 wherein the securing means for the clip means is the same as the securing means holding the ends of the tubes to the arms.

14. A system according to claim 10 wherein the tubes are provided with centrally disposed, longitudinally extending grooves on each of their surfaces.

15. A system according to claim 14 further comprising a bar with means associated therewith for releasably securing the bar in the longitudinal groove, the bar having outward extensions for supporting edges of panels.

16. A system according to claim 15 wherein the bar securing means are the same as the securing means holding the tube ends on the arms.

* * * * *